US007405699B2

(12) United States Patent
Qin

(10) Patent No.: US 7,405,699 B2
(45) Date of Patent: Jul. 29, 2008

(54) MULTIPLE INPUT MULTIPLE OUTPUT ANTENNA

(75) Inventor: Xiang-Hong Qin, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/615,018

(22) Filed: Dec. 22, 2006

(65) Prior Publication Data

US 2008/0094282 A1 Apr. 24, 2008

(30) Foreign Application Priority Data

Oct. 20, 2006 (TW) ..... 95138886 A

(51) Int. Cl.
*H01Q 1/38* (2006.01)

(52) U.S. Cl. ..... 343/700 MS; 343/829; 343/846; 343/770; 343/853

(58) Field of Classification Search ..... 343/700 MS
See application file for complete search history.

(56) References Cited

U.S. PATENT DOCUMENTS 6,801,168 B1 * 10/2004 Yeh ..... 343/700 MS
2003/0034917 A1 * 2/2003 Nishizawa et al. .... 343/700 MS
2004/0164906 A1 * 8/2004 Shih ..... 343/700 MS
2006/0071858 A1 * 4/2006 Suh ..... 343/700 MS
2006/0170594 A1 * 8/2006 Cheng ..... 343/700 MS
2007/0279285 A1 * 12/2007 Hilgers ..... 343/700 MS
2007/0285331 A1 * 12/2007 Sarabandi et al. ..... 343/866
2008/0012769 A1 * 1/2008 Cheng ..... 343/700 MS

FOREIGN PATENT DOCUMENTS

CN 1474478 A 2/2004

* cited by examiner

*Primary Examiner*—Trinh V Dinh
(74) *Attorney, Agent, or Firm*—Wei Te Chung

(57) ABSTRACT

A MIMO antenna (20) disposed on a substrate (10) including a first surface (102) and a second surface (104). The MIMO antenna includes a first antenna (20*a*) and a second antenna (20*b*) each including a radiating body (22*a*), a feeding portion (26*a*) electrically connected to the radiating body, and a metallic ground plane (24*a*). The radiating body includes a first radiating portion (222*a*), a second radiating portion (226*a*), and a gap (28*a*) formed between the first radiating portion and the second radiating portion. The radiating body and the feeding portion of the first antenna and the ground plane of the second antenna are laid on the first surface of the substrate, and the radiating body and the feeding portion of the second antenna and the ground plane of the first antenna are laid on the second surface of the substrate.

18 Claims, 6 Drawing Sheets

MULTIPLE INPUT MULTIPLE OUTPUT ANTENNA

BACKGROUND OF THE INVENTION

1. Field of the Invention

The invention relates to multiple input multiple output (MIMO) antennas, and particularly to a MIMO antenna for use in ultra-wideband (UWB) communication systems.

2. Description of Related Art

A frequency band of an UWB wireless communication system is 3.1-10.6 GHz. In a wireless communication system, the antenna is a key element for radiating and receiving radio frequency signals. Therefore, an operating frequency band of the antenna must be 3.1-10.6 GHz or greater. In wireless communications, the number of users continues to increase and data traffic is becoming an increasing more important part of the wireless communication system. Both of these factors mean that it is important for operators to look for methods of increasing the capacity of their wireless communication systems to meet future demands.

A relatively new radio communications technology known as multiple input multiple output (MIMO) systems provides for increased system capacity. A number of antennas are used on both the transmitter and receiver, which together with appropriate beam forming and signal processing technologies are capable of providing two or more orthogonal radio propagation channels between the two antennas. The antennas are spaced apart in order to decorrelate the signals associated with adjacent antennas.

There is a need for improved antenna arrangements for use with UWB MIMO systems.

SUMMARY OF THE INVENTION

An exemplary embodiment of the present invention provides a MIMO antenna disposed on a substrate including a first surface and a second surface. The MIMO antenna includes a first antenna and a second antenna. The first antenna and the second antenna each include a radiating body for transmitting and receiving radio frequency (RF) signals, a feeding portion for feeding signals, and a metallic ground plane. The radiating body includes a first radiating portion, a second radiating portion, and a gap formed between the first radiating portion and the second radiating portion. The feeding portion is electrically connected to the radiating body. The radiating body and the feeding portion of the first antenna and the ground plane of the second antenna are laid on the first surface of the substrate, and the radiating body and the feeding portion of the second antenna and the ground plane of the first antenna are laid on the second surface of the substrate.

Other advantages and novel features will become more apparent from the following detailed description when taken in conjunction with the accompanying drawings, in which:

DETAILED DESCRIPTION OF THE INVENTION

Figure 1:
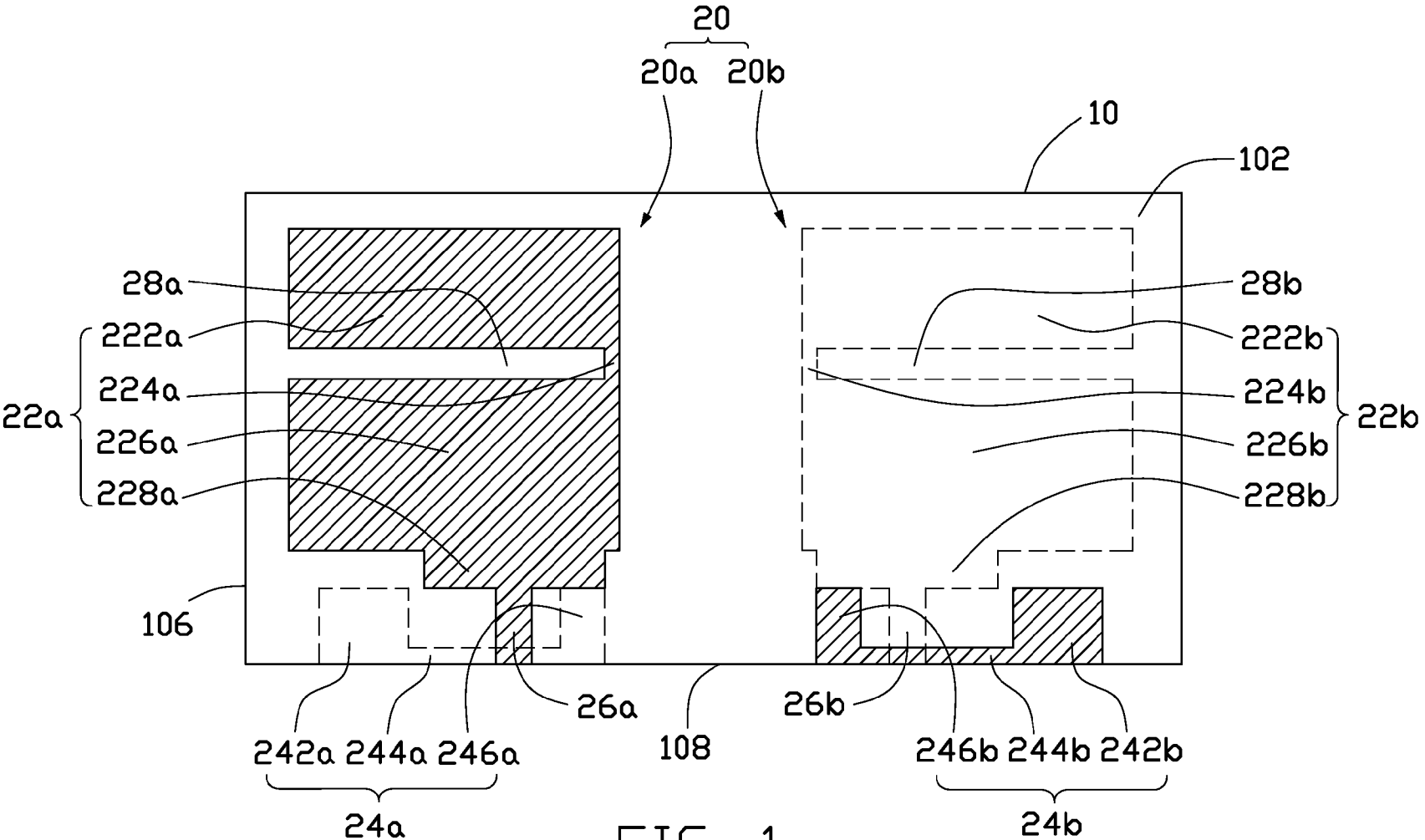
FIG. 1 is a schematic plan view of a multi input multi output (MIMO) antenna of an exemplary embodiment of the present invention, the MIMO antenna including a first antenna and a second antenna.

FIG. 1 is a schematic plan view of a multi input multi output (MIMO) antenna 20 of an exemplary embodiment of the present invention. In the exemplary embodiment, the MIMO antenna 20 is printed on a substrate 10.

Figure 2:
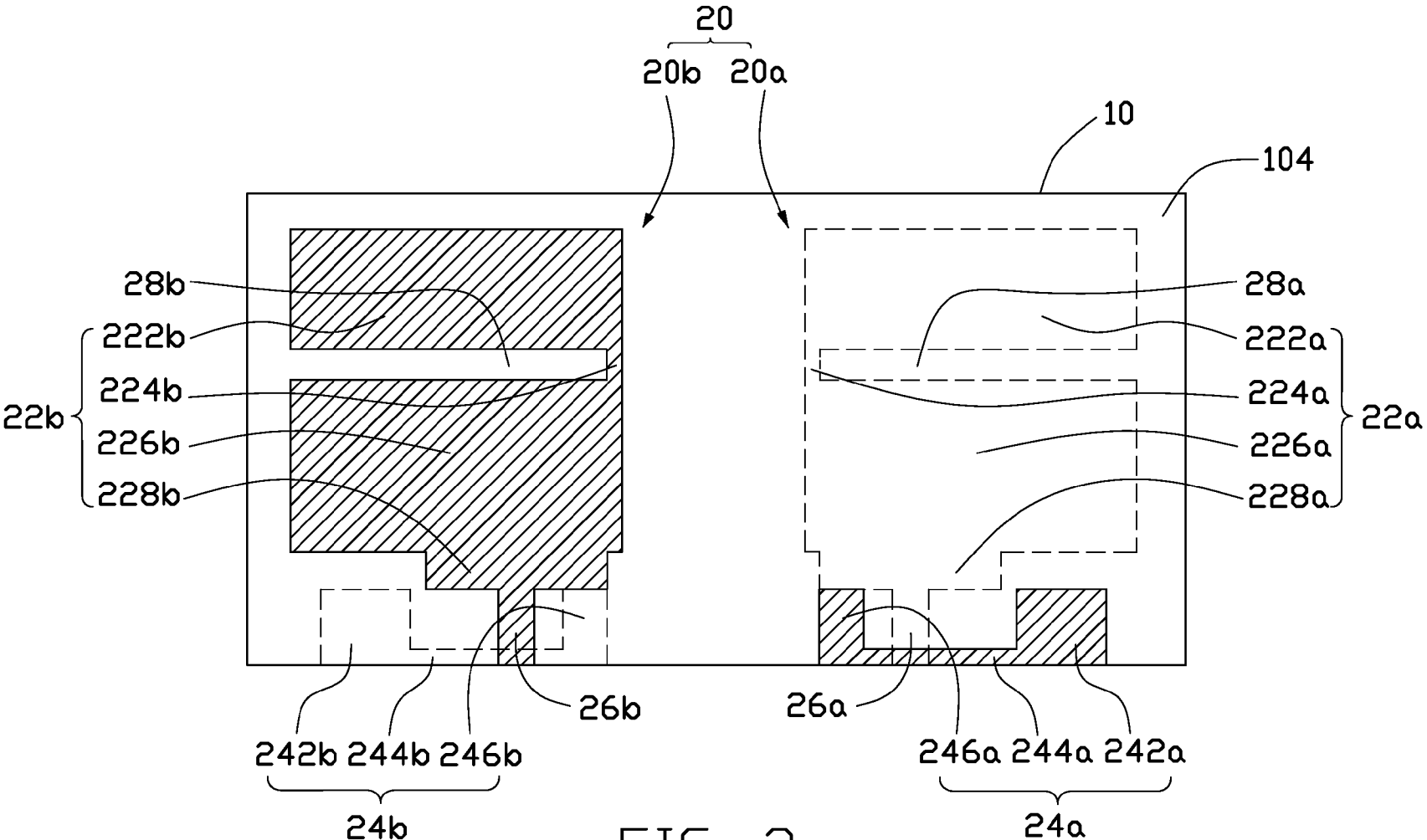
FIG. 2 is similar to FIG. 1, but viewed from another aspect.

Referring also to FIG. 2, the substrate 10 comprises a first surface 102, a second surface 104 parallel to the first surface 102, a first side 106, and a second side 108 perpendicular to the first side 106.

The MIMO antenna 20 comprises a first antenna 20*a* and a second antenna 20*b*.

The first antenna 20*a* comprises a radiating body 22*a*, a metallic ground plane 24*a*, and a feeding portion 26*a*. The radiating body 22*a* and the feeding portion 26*a* are printed on the first surface 102. The ground plane 24*a* is printed on the second surface 104.

The radiating body 22*a* transmits and receives radio frequency (RF) signals. The radiating body 22*a* comprises a first radiating portion 222*a*, a second radiating portion 226*a*, a first connecting portion 224*a*, and a second connecting portion 228*a*. A gap 28*a* is formed among the first radiating portion 222*a*, the second radiating portion 226*a*, and the first connecting portion 224*a*, and extends from a side of the radiating body 22*a* adjacent to the first side 106 of the substrate 10 to the first connecting portion 224*a*. The first radiating portion 222*a* is electrically connected to the second radiating portion 226*a* via the first connecting portion 224*a*. The second radiating portion 226*a* is electrically connected to the feeding portion 26*a* via the second connecting portion 228*a*. In an alternation embodiment, the first connecting portion 224*a* is defined as a part of the first radiating portion 222*a*, and the second connecting portion 228*a* is defined as a part of the second radiating portion 226*a*.

The feeding portion 26*a* is electrically connected to and feeds signals to the second radiating portion 226*a*. The feeding portion 26*a* is generally parallel to the first side 106 of the substrate 10, and is a 50Ω transmission line.

The ground plane 24*a* is adjacent to the second connecting portion 228*a*, and comprises a rectangular first ground portion 242*a*, a rectangular second ground portion 246*a*, and a rectangular third ground portion 244*a* connecting the first ground portion 242*a* with the second ground portion 246*a*. A length of the first ground portion 242*a* along a direction parallel to the second side 108 is greater than that of the second ground portion 246*a*.

The second antenna 20*b* comprises a radiating body 22*b*, a metallic ground plane 24*b*, and a feeding portion 26*b*. The radiating body 22*b* comprises a first radiating portion 222*b*, a second radiating portion 226*b*, a first connecting portion 224*b*, and a second connecting portion 228*b*. A gap 28*b* is formed among the first radiating portion 222*b*, the second radiating portion 226*b*, and the first connecting portion 224*b*. The first radiating portion 222*b* is electrically connected to the second radiating portion 226*b* via the first connecting portion 224*b*. The second radiating portion 226*b* is electrically connected to the feeding portion 26*b* via the second connecting portion 228*b*. The ground plane 24*b* comprises a first ground portion 242*b*, a second ground portion 246*b*, and a third ground portion 244*b*. Configurations of all elements of the second antenna 20*b* and relations among the elements of the second antenna 20*b* are the same as those of the first antenna 20*a*. The radiating body 22*b* and the feeding portion 26*b* of the second antenna 20*b* are printed on the second surface 104 of the substrate 10. That is, the radiating body 22*b* and the feeding portion 26*b* of the second antenna 20*b*, and the ground plane 24*a* of the first antenna 20*a* are laid on the same second surface 104 of the substrate 10. The ground plane 24*b* of the second antenna 20*b* is printed on the first surface 104 of the substrate 10. That is, the radiating body 22*a* and the feeding portion 26*a* of the first antenna 20*a*, and the ground plane 24*b* of the second antenna 20*b* are located on the same first surface 102 of the substrate 10.

In the exemplary embodiment, the radiating bodys 20*a*, 20*b* increase bandwidth of the MIMO antenna 20.

In addition, the MIMO antenna 20 has a low profile and a small size because of the gaps 28*a*/28*b* formed between the first radiating portions 222*a*/222*b* and the second radiating portions 226*a*/226*b*.

Figure 3:
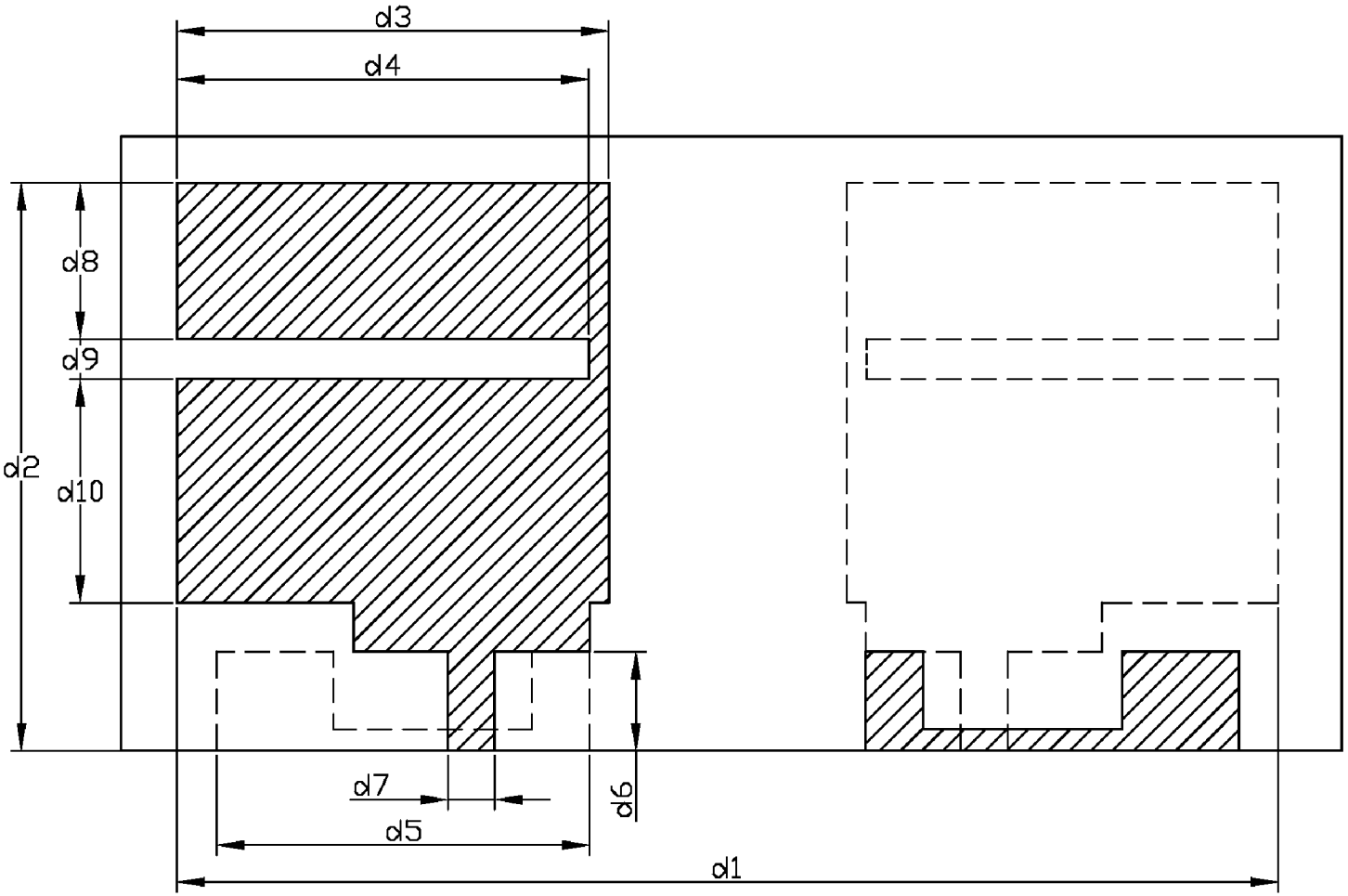
FIG. 3 is a schematic plan view illustrating dimensions of the first antenna of the MIMO antenna of FIG. 1.

FIG. 3 is a schematic plan view illustrating dimensions of the MIMO antenna 20 of FIG. 1. In the exemplary embodiment, a length d1 of the MIMO antenna 20 is generally 28 mm, and a width d2 of the MIMO antenna 20 is generally 14.5 mm. A width d3 of the radiating body 22*a* of the first antenna 20*a* is generally 11 mm. A width d8 of the first radiating portion 222*a* is generally 4 mm. A width d10 of the second radiating portion 226*a* is generally 5.75 mm. A length d4 of the gap 28*a* is generally 10.5 mm. A width d9 of the gap 28*a* is generally 1 mm. A length d5 of the ground plane 24*a* is generally 9.5 mm. A width d6 of the ground plane 24*a* is generally 2.5 mm. A width d7 of the feeding portion 26*a* is generally 1.2 mm. A length of the feeding portion 26*a* is generally equal to d6. That is, the length of the feeding portion 26*a* is equal to the width of the ground plane 24*a*. Lengths and widths of the all elements of the second antenna 20*b* are generally equal to those of the first antenna 20*a*, respectively.

Figure 4:
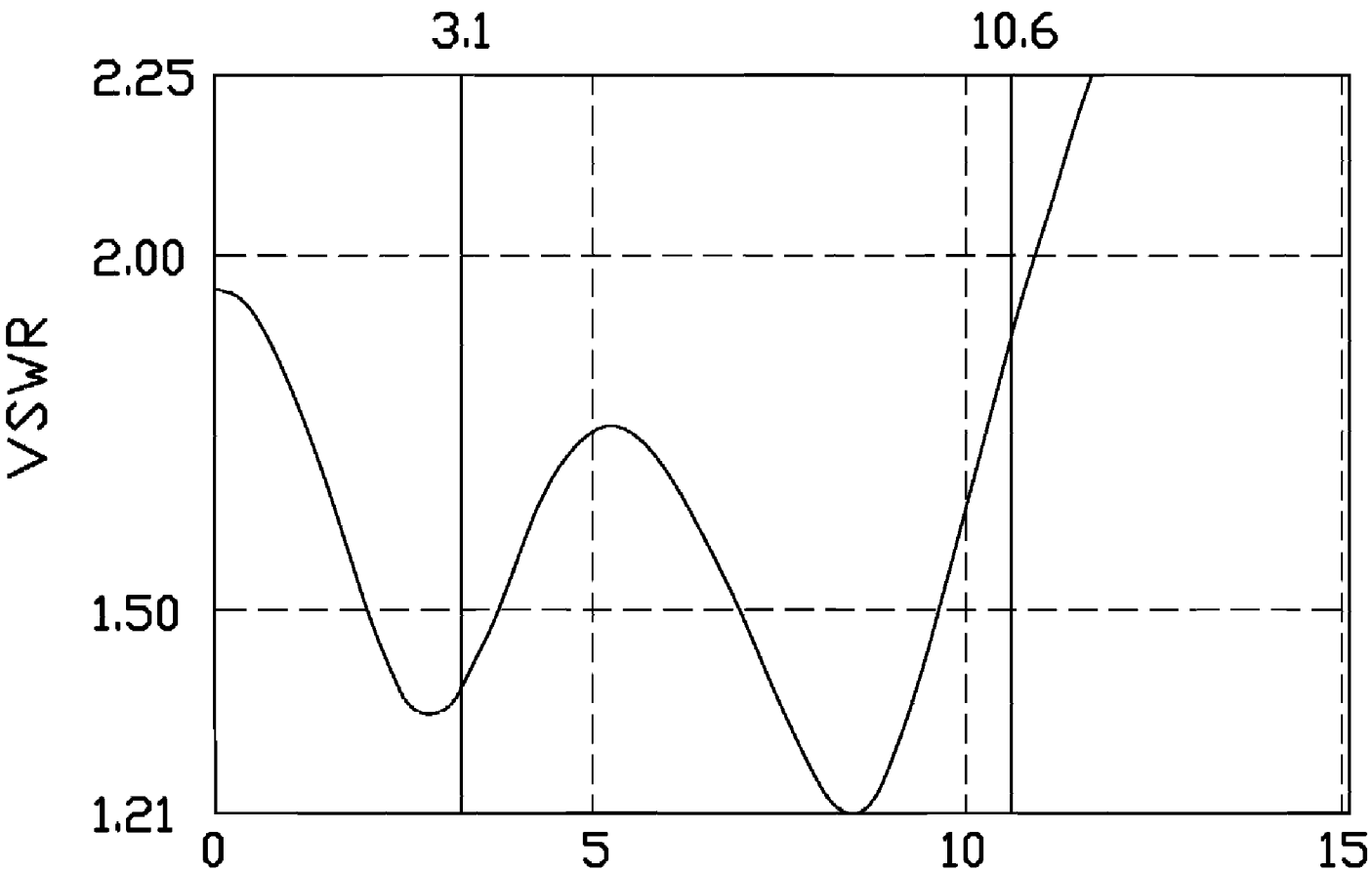
FIG. 4 is a graph of test results showing a voltage standing wave ratio (VSWR) of the first antenna of FIG. 1.

FIG. 4 is a graph of test results showing voltage standing wave ratio (VSWR) at UWB frequencies, of the first antenna 20*a*. A horizontal axis represents the frequency (in GHz) of the electromagnetic signals traveling through the first antenna 20*a*, and a vertical axis represents a VSWR. VSWR of the first antenna 20*a* over the UWB range of frequencies is indicated by a curve. As shown in FIG. 4, the first antenna 20*a* has a good performance when operating at frequencies from 3.1-10.6 GHz. The amplitudes of the VSWRs in the band pass frequency range are less than 2, which is what is required for an antenna used in UWB systems.

Figure 5:
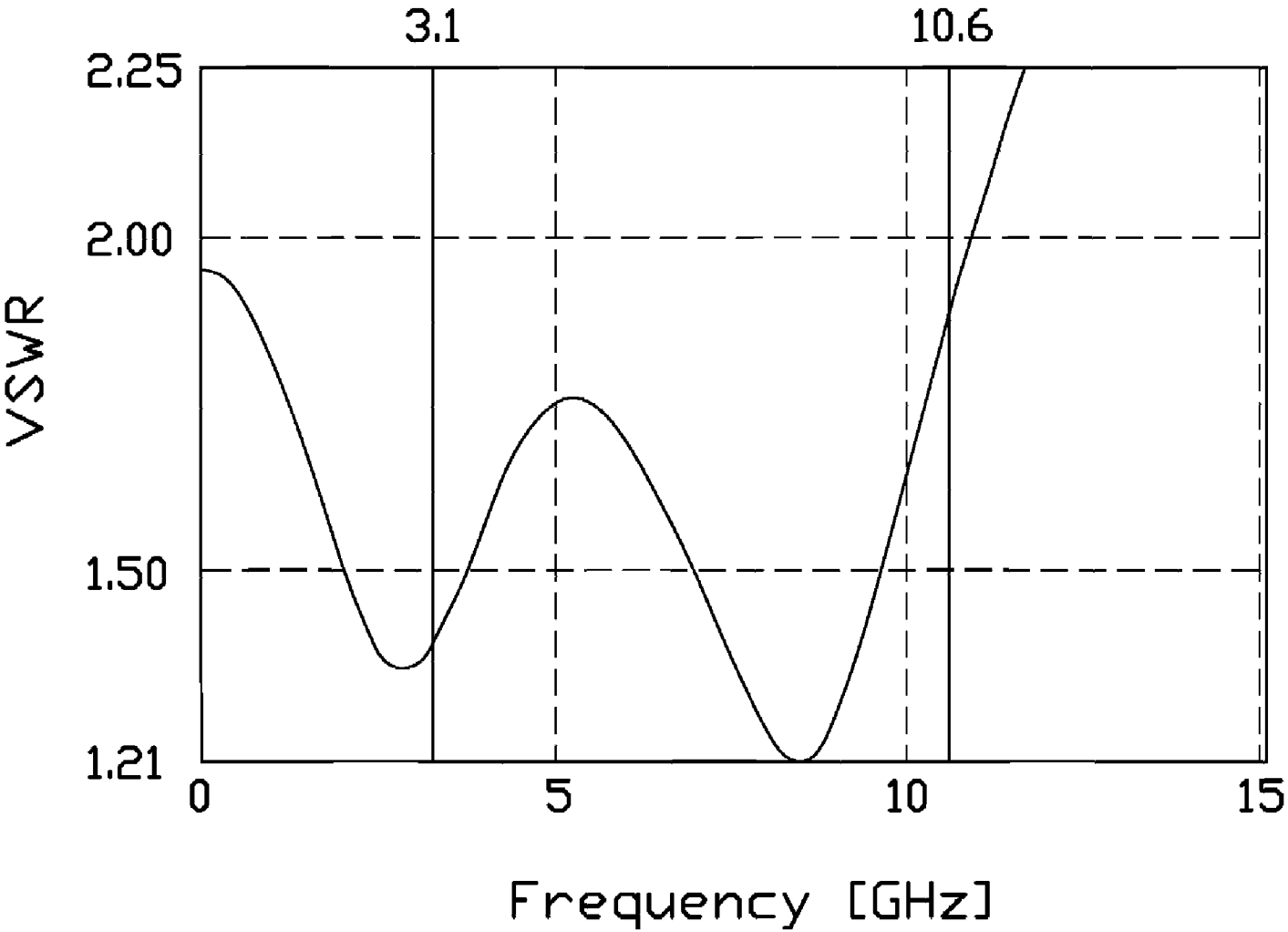
FIG. 5 is a graph of test results showing a VSWR of the second antenna of FIG. 2.

FIG. 5 is a graph of test results showing voltage standing wave ratio (VSWR) at UWB frequencies, of the second antenna 20*b*. A horizontal axis represents the frequency (in GHz) of the electromagnetic signals traveling through the second antenna 20*b*, and a vertical axis represents a VSWR. VSWR of the first antenna 20*a* over the UWB range of frequencies is indicated by a curve. As shown in FIG. 5, the second antenna 20*b* has a good performance when operating at frequencies from 3.1-10.6 GHz. The amplitudes of the VSWRs in the band pass frequency range are also less than 2.

Figure 6:
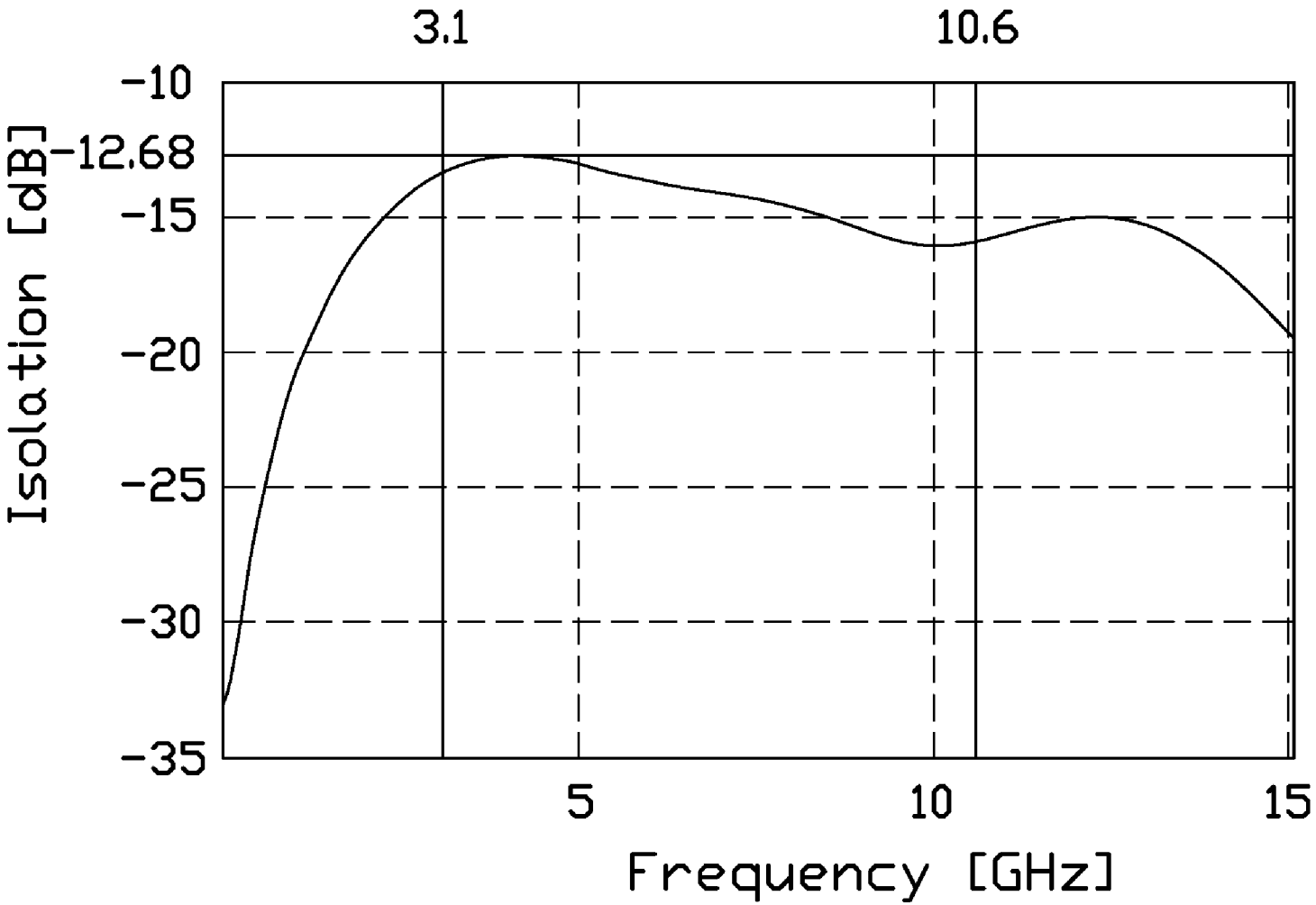
FIG. 6 is a graph of test results showing an isolation between the first antenna and the second antenna of FIG. 1.

FIG. 6 is a graph of test results showing isolation between the first antenna 20*a* and the second antenna 20*b* of the MIMO antenna 20. A horizontal axis represents the frequency (in GHz) of the electromagnetic signals traveling through the MIMO antenna 20, and a vertical axis indicates amplitude of isolation. A curve represents amplitudes of isolation over the range of frequencies. As shown in FIG. 6, the values of isolation never go higher than approximately −12.68 dB over the UWB range of frequencies. The highest isolation value is less than −10, indicating the MIMO antenna 20 is suitable for use in UWB systems.

In this embodiment, the radiating portion 22*a* of the first antenna 22*a* and the radiation portion 22*b* of the second antenna 22*b* are disposed on different surfaces of the substrate 200, therefore, the isolation between the first antenna 22*a* and the second antenna 22*b* is good.

While embodiments of the present invention have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A multi input multi output (MIMO) antenna printed on a substrate comprising a first surface and a second surface, the MIMO antenna comprising a first antenna and a second antenna, the first antenna and the second antenna each comprising:

a radiating body for transmitting and receiving radio frequency (RF) signals, the radiating body comprising a first radiating portion, a second radiating portion and a first connecting portion electrically connecting the first radiating portion with second radiating portion;

a feeding portion, for feeding signals, the feeding portion electrically connected to the radiating body; and a metallic ground plane comprising a first ground portion and a second ground portion;

wherein, the radiating body and the feeding portion of the first antenna and the ground plane of the second antenna are printed on the first surface of the substrate, and the radiating body and the feeding portion of the second antenna and the ground plane of the first antenna are printed on the second surface of the substrate.

2. The MIMO antenna as claimed in claim 1, wherein an operating frequency band of the first antenna is 3.1-10.6 GHz.

3. The MIMO antenna as claimed in claim 1, wherein an operating frequency band of the second antenna is 3.1-10.6 GHz.

4. The MIMO antenna as claimed in claim 1, wherein a gap is formed among the first radiating portion, the first connecting portion, and the second radiating portion.

5. The MIMO antenna as claimed in claim 4, wherein the gap separates the first radiating portion and the second radiating portion.

6. The MIMO antenna as claimed in claim 1, further comprising a second connecting portion electrically connecting the feeding portion with the second radiating portion.

7. The MIMO antenna as claimed in claim 1, wherein the ground plane further comprises a third ground portion electrically connecting the first ground portion and the second ground portion.

8. The MIMO antenna as claimed in claim 1, wherein Lengths and widths of all elements of the second antenna are generally equal to those of the first antenna, respectively.

9. The MIMO antenna as claimed in claim 1, wherein the length of the feeding portion is equal to the width of the ground plane.

10. The MIMO antenna as claimed in claim 1, wherein a width of the first radiating portion is generally equal to that of the second radiating portion.

11. A multi input multi output (MIMO) antenna disposed on a substrate comprising a first surface and a second surface, the MIMO antenna comprising a first antenna and a second antenna, the first antenna and the second antenna each comprising:

a radiating body for transmitting and receiving radio frequency (RF) signals, the radiating body comprising a first radiating portion, a second radiating portion, and a gap formed between the first radiating portion and the second radiating portion;

a feeding portion, for feeding signals, the feeding portion electrically connected to the radiating body; and a metallic ground plane;

wherein, the radiating body and the feeding portion of the first antenna and the ground plane of the second antenna are laid on the first surface of the substrate, and the radiating body and the feeding portion of the second antenna and the ground plane of the first antenna are laid on the second surface of the substrate.

12. The MIMO antenna as claimed in claim 11, wherein an operating frequency band of the first antenna is 3.1-10.6 GHz.

13. The MIMO antenna as claimed in claim 11, wherein an operating frequency band of the second antenna is 3.1-10.6 GHz.

14. The MIMO antenna as claimed in claim 11, wherein the length of the feeding portion is equal to the width of the ground plane.

15. The MIMO antenna as claimed in claim 11, wherein Lengths and widths of all elements of the second antenna are generally equal to those of the first antenna, respectively.

16. The MIMO antenna as claimed in claim 11, wherein the gap partly separates the first radiating portion and the second radiating portion.

17. An assembly comprising:

a substrate comprising a first surface and a second surface opposite to said first surface; and a multi input multi output (MIMO) antenna disposed on said substrate, said MIMO antenna comprising a first antenna mainly formed on said first surface of said substrate and a second antenna mainly formed on said second surface of said substrate, said first antenna comprising a first feeding portion formed on said first surface for feeding signals to said first antenna, and a first radiating body formed on said first surface and electrically connectable with said first feeding portion to transmit and receive radio frequency (RF) signals for said first antenna, said second antenna comprising a second feeding portion formed on said second surface for feeding signals to said second antenna, and a second radiating body formed on said second surface and electrically connectable with said second feeding portion to transmit and receive radio frequency (RF) signals for said second antenna, said first radiating body and said first feeding portion of said first antenna being spaced from a projection of said second radiating body and said second feeding portion of said second antenna on said first surface of said substrate without overlapping therewith.

18. The assembly as claimed in claim 17, wherein said first antenna comprises a first ground plane formed on said second surface of said substrate next to said second radiating body and said second feeding portion of said second antenna, and said second antenna comprises a second ground plane formed on said first surface of said substrate next to said first radiating body and said first feeding portion of said first antenna.

* * * * *